US007229279B2

(12) United States Patent
Wahl et al.

(10) Patent No.: US 7,229,279 B2
(45) Date of Patent: Jun. 12, 2007

(54) COMBUSTION CHAMBER SUBASSEMBLY FOR A HEATING DEVICE, PARTICULARLY A VEHICLE HEATING DEVICE

(75) Inventors: Hermann Wahl, Eislingen (DE); Peter Scholz, Stuttgart (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 182 days.

(21) Appl. No.: 10/723,201

(22) Filed: Nov. 26, 2003

(65) Prior Publication Data

US 2004/0209214 A1 Oct. 21, 2004

(30) Foreign Application Priority Data

Nov. 27, 2002 (DE) ..... 102 55 361

(51) Int. Cl.
*F23Q 3/00* (2006.01)
*F23D 14/12* (2006.01)

(52) U.S. Cl. ..... 431/261; 431/328

(58) Field of Classification Search ..... 431/261, 431/326, 328

See application file for complete search history.

(56) References Cited

U.S. PATENT DOCUMENTS

| | | | | |
|---|---|---|---|---|
| 5,088,918 | A | 2/1992 | Schaale et al. | |
| 5,605,453 | A | 2/1997 | Kenner et al. | |
| 5,611,684 | A * | 3/1997 | Spielman | 431/353 |
| 5,993,197 | A | 11/1999 | Alber et al. | |
| 6,027,334 | A | 2/2000 | Blaschke | |
| 6,427,924 | B2 | 8/2002 | Takagi et al. | |
| 6,709,264 | B2 * | 3/2004 | Hermann et al. | 431/170 |
| 2003/0027090 | A1 | 2/2003 | Blaschke et al. | |

FOREIGN PATENT DOCUMENTS

| | | |
|---|---|---|
| DE | 40 03 090 C1 | 2/1990 |
| DE | G 92 10 028.7 | 7/1992 |
| DE | 43 28 790 A1 | 8/1993 |
| DE | 44 42 425 A 1 | 11/1994 |
| DE | 195 29 994 A1 | 8/1995 |
| DE | 101 20 027 A1 | 4/2001 |
| DE | 101 30 638 A1 | 6/2001 |
| JP | 57157915 | 9/1982 |

OTHER PUBLICATIONS

European Search Report for Corresponding Application No. 03012202.1-2301- dated Feb. 10, 2004.

* cited by examiner

*Primary Examiner*—Alfred Basichas

(57) ABSTRACT

A combustion chamber subassembly for a vehicle heating device, includes a housing with a housing wall and a fuel feed through the housing wall, a fuel distribution element covering the housing wall on the side facing toward a combustion chamber and together with the housing wall bounding a fuel distribution channel arrangement, a plurality of fuel inlet apertures being formed in the fuel distribution element for conducting fuel from the fuel distribution channel arrangement toward the combustion chamber.

6 Claims, 1 Drawing Sheet

COMBUSTION CHAMBER SUBASSEMBLY FOR A HEATING DEVICE, PARTICULARLY A VEHICLE HEATING DEVICE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a combustion chamber subassembly for a heating device, particularly a vehicle heating device, including a housing with a housing wall and a fuel supply through the housing wall.

PRIOR ART

In fuel-operated vehicle heating devices, which are to be built in as auxiliary heating or as supplementary heaters in vehicles or trailers, the mounting position generally depends on the specific vehicle type. The heating performance should however remain constant, independent of the mounting position. In evaporative burners, in which the fuel is delivered into a combustion chamber via a porous medium, the problem exists that the introduction of the fuel into this porous evaporator medium can be impaired by changing the mounting position, since the fuel is generally distributed by gravity before introduction and after introduction into this porous medium. A very non-uniform distribution leads to a correspondingly non-uniform evaporation of fuel in the combustion chamber, which can have the consequences that the combustion taking place in the combustion chamber leads to an increased exhaust gas emission, that the starting process of such a combustion chamber is impaired, and that excessive accumulation of combustion residues in the combustion chamber occurs, which in extreme cases can lead to failure of the combustion chamber.

BRIEF SUMMARY OF THE INVENTION

The present invention has as its object to provide a combustion chamber subassembly for a heating device, in particular for a vehicle, in which a fuel distribution substantially independent of the mounting position is provided for.

According to the present invention, this object is attained by a combustion chamber subassembly for a heating device, in particular a vehicle heating device, including a housing with a housing wall and a fuel supply through the housing wall, a fuel distribution element covering the housing wall at the side toward the combustion chamber and, together with the housing wall, limiting a fuel distribution channel arrangement, a plurality of fuel inlet apertures being formed in the fuel distribution element for conducting fuel from the fuel distribution channel arrangement toward the combustion chamber.

The fuel is thus not delivered directly from the fuel supply toward the combustion chamber, but instead there is a pre-distribution, which results in an evening out of the fuel introduction into the combustion chamber and thus a markedly improved independence on the mounting position. For example, it can be provided that a groove-like recess is formed for forming the fuel distribution channel arrangement in the housing wall.

In order to ensure that the fuel forwarded by the fuel feed cannot directly then enter the combustion chamber through at least one of the fuel inlet apertures, it is proposed that the fuel feed includes at least one fuel feed aperture opening into the fuel distribution channel arrangement, and that the at least one fuel feed aperture is offset with respect to the fuel inlet apertures. Here at least one fuel feed aperture opens into the fuel distribution channel arrangement in the region between the fuel inlet apertures.

As already mentioned hereinabove, in the arrangement according to the invention an evaporator medium is provided, receiving fuel from the fuel inlet aperture, on the side of the fuel distribution element facing toward the combustion chamber. This evaporator medium, in general thus a porous evaporator medium, can for example include non-woven material, woven material, spun yarn, braided material, foamed ceramic material, or any material which because of its structural composition or its porosity can provide for the forwarding or distribution of fuel introduced into it.

It can be provided that the housing is formed in a pot shape, with a floor and an annular peripheral wall, the fuel distribution element being annular and at least regionally covering the peripheral wall of the housing.

To provide for a good mixing with combustion air of the evaporated fuel delivered into the combustion chamber, at least one combustion air inlet aperture is formed at a region of the peripheral wall not covered by the fuel distribution element.

To further the evaporation of the fuel, which in particular improves the starting behavior at low environmental temperatures, the fuel distribution element forms or contains at least a portion of a heating arrangement.

The invention furthermore relates to a vehicle heating device with a combustion chamber subassembly according to the invention.

BRIEF DESCRIPTION OF THE DRAWINGS

The present invention is described in detail hereinafter with reference to the accompanying drawings.

DETAILED DESCRIPTION OF INVENTION

Figure 1:
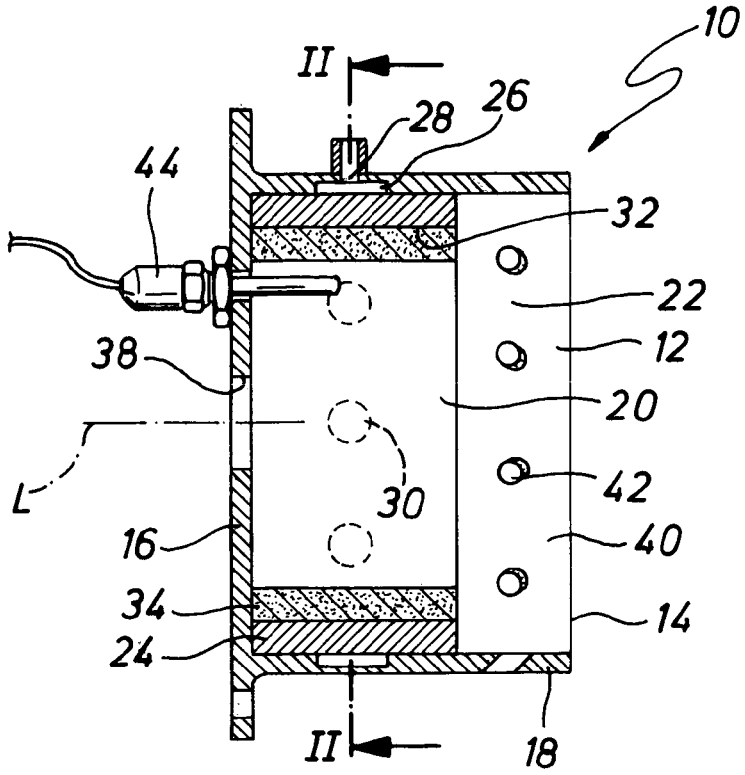
FIG. 1 shows a longitudinal section of a combustion chamber subassembly according to the invention.

In the Figures, a combustion chamber subassembly according to the invention is denoted with the reference numeral 10. The combustion chamber subassembly 10 comprises a housing 12, which in general forms a wall 14 with a pot-like structure. This wall 14 includes a floor 16 and adjoining this a substantially cylindrical or else annular peripheral wall 18. A likewise cylindrical or annular fuel distribution element 24 is arranged on an inner side 22 of the peripheral wall surrounding the combustion chamber 20, abuts flush on the inner side 22 of the peripheral wall 18, and in the example shown is positioned adjoining the floor 16. An annular recess 26 is provided, for example by milling out, on the inner side 22 of the peripheral wall 18, and forms a fuel distribution channel 18. Fuel can be introduced into this annular recess 26 through a fuel feed aperture 28 in the peripheral wall 18 via a fuel feed duct (not shown). This recess 26 is closed radially inward with respect to a longitudinal axis L by the fuel distribution element 24. However, fuel inlet apertures 30 are provided at plural peripheral positions in the fuel distribution element 24. The fuel introduced into the recess 26 or into the fuel distribution channel can flow further through these fuel inlet apertures 30 toward the combustion chamber 20 after it has been distributed, with relatively low flow resistance, in the peripheral direction in this recess 26 around the longitudinal axis L. The fuel flowing through the fuel inlet apertures 30 then enters a porous evaporator medium 34 provided on the inner side 32 of the fuel distribution element 24. This preferably covers the inner side 32 of the fuel distribution element 24 over the whole surface, i.e., it is likewise substantially of annular form and has the same axial extension length as the fuel distribution element 24. By the prior evening out of the fuel introduction provided by the recess 26, and furthermore by the distribution of the liquid fuel in the evaporator medium 34 by capillary action, a very uniform delivery of the fuel to the inner side 26 of the evaporator medium 34 in the direction toward the combustion chamber 20 is obtained.

Figure 2:
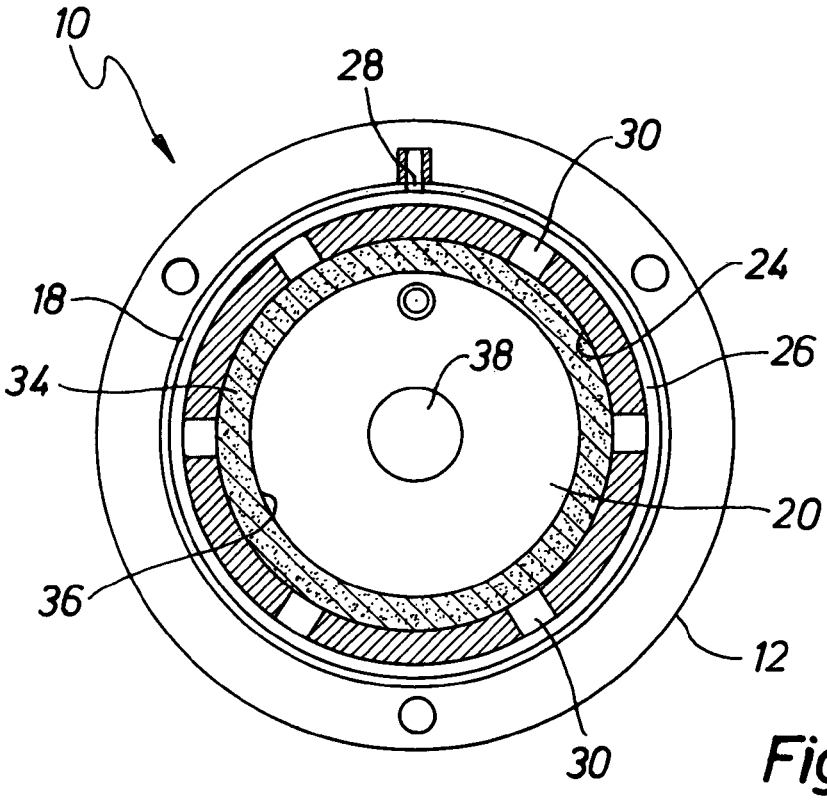
FIG. 2 shows a sectional view of the combustion chamber subassembly of FIG. 1, sectioned along a line II—II in FIG. 1.

It can be seen in FIG. 2 that the fuel feed aperture 28 opens in the peripheral direction at a position in the recess 26 which is offset relative to the fuel inlet apertures 30. Fuel is thereby prevented from entering directly from the fuel feed aperture 28 into one of the fuel inlet apertures 30 and then intensified there into the porous evaporator medium 34.

The combustion air is introduced in the example shown at two regions in the combustion chamber 20. On the one hand, a combustion air inlet aperture 38 is provided in the central region of the floor 16; on the other hand, a plurality of combustion air inlet apertures 42 is provided, distributed in the peripheral direction in the region 40 of the peripheral wall 18 not covered by the fuel distribution element 24, so that likewise a very uniform distribution of the combustion air into the combustion chamber 20 results. It should be mentioned that of course the combustion air can also be introduced into the combustion chamber 20 only in the region of the floor 16, or else only in the region of the peripheral wall 18.

Furthermore an ignition member 44, for example in the form of a glow ignition pin, is provided on the floor 16 and can provide the high temperatures required to start the combustion. This also can of course be provided at another position, for example, also on the peripheral wall 18 and projecting through the fuel distribution element 24 or the evaporator medium 34.

In order to be able to accelerate the evaporation of the fuel, particularly in the cold start phase in which the combustion chamber subassembly 10 is not yet preheated by the ongoing combustion, it is possible to keep a heating arrangement in readiness in the fuel distribution element 24, for example in the form of a heating coil or the like, or to form the fuel distribution element 24 as a portion of such a heating device, so that by excitation of this electrically operable heating device, the porous evaporator medium 34 and thus also the liquid fuel contained therein are heated and thus the evaporation rate can be increased.

It goes without saying that various modifications are possible to the combustion chamber subassembly 10 described hereinabove without departing from the principle of the present invention. Thus the recess 26, instead of or additionally to being provided in the peripheral wall 18, can also be provided on the outer peripheral side of the fuel distribution element 24. Furthermore, it is possible that the recess 26 can have plural recess sections, in order to conduct the fuel into different peripheral regions or also axial regions in a defined manner. It is also possible to provide plural such annular recesses in axial succession and to supply these through a single or through respectively separate fuel feed apertures.

The combustion chamber subassembly 10 shown in the Figures, or respectively a heating device having the same, is for example built in so that basically the fuel feed aperture is situated on the upper side. Even if such a mounting position is deviated for example in an angular range of 90° to one or other side, a very uniform distribution of the fuel is furthermore provided for by the provision of the recess 26 or the fuel inlet apertures 30. This means that there is a great deal of freedom when installing such a device in a vehicle, without the mixture formation and thus the combustion being substantially impaired thereby. All of this can be attained by a very simple and thus also cost-effective construction.

The invention claimed is:

1. A combustion chamber subassembly for a heating device comprising: a housing with a floor (16) and an annular peripheral wall (18), a fuel feed (28) for feeding liquid fuel through the peripheral wall (18), a fuel distribution channel arrangement 26, a fuel distribution element (24) covering the peripheral wall (18) on a side facing toward a combustion chamber (20) and which, together with the peripheral wall (18), bounds the fuel distribution channel arrangement (26), and a plurality of fuel inlet apertures (30) in the fuel distribution element (24) that conducts liquid fuel from the fuel distribution channel arrangement (26) toward the combustion chamber (20), wherein the fuel distribution element (24) is of annular form and at least regionally covers the peripheral wall (18) of the housing (12).

2. The combustion chamber subassembly according to claim 1, further comprising a groove-like recess (26) in at least one of the peripheral wall (18) and the fuel distribution element (24) for forming the fuel distribution channel arrangement (26).

3. The combustion chamber subassembly according to claim 1, wherein the fuel feed (28) includes at least one fuel feed aperture (28) in the peripheral wall (18) opening into the fuel distribution channel arrangement (26), and wherein the at least one fuel feed aperture (28) is offset with respect to the fuel inlet apertures (30).

4. The combustion chamber subassembly according to claim 3, wherein the at least one fuel feed aperture (28) opens into the fuel distribution channel arrangement (26) in a region between two of the plurality of fuel inlet apertures (30).

5. The combustion chamber subassembly according to claim 4, further comprising an evaporator medium (34), that receives fuel from the fuel inlet apertures (30) on a side (32) of the fuel distribution element (24) facing toward the combustion chamber (20).

6. The combustion chamber subassembly according to claim 1, wherein at least one combustion air inlet aperture (42) is formed on a region of the peripheral wall (18) not covered by the fuel distribution element (24).

* * * * *